United States Patent [19]

Clark

[11] Patent Number: 4,531,840

[45] Date of Patent: Jul. 30, 1985

[54] SOLVENT PROPORTIONING AND MIXING APPARATUS AND SYSTEM

[75] Inventor: Keith S. Clark, Sunnyvale, Calif.

[73] Assignee: Eldex Laboratories, Inc., Menlo Park, Calif.

[21] Appl. No.: 561,219

[22] Filed: Dec. 14, 1983

[51] Int. Cl.[3] ..... B01F 15/02

[52] U.S. Cl. ..... 366/142; 366/160; 366/179; 366/182; 366/601

[58] Field of Search ..... 137/624.11, 625.41; 222/144.5; 366/134, 142, 160, 162, 167, 168, 169, 172, 173, 177, 179, 182, 341, 601; 422/100

[56] References Cited

U.S. PATENT DOCUMENTS

| | | | |
|---|---|---|---|
| 3,057,350 | 10/1962 | Cowley | 137/625.41 |
| 3,473,571 | 10/1969 | Dugay | 137/625.41 |
| 4,063,077 | 12/1977 | Wright | 364/502 |

*Primary Examiner*—Robert W. Jenkins
*Assistant Examiner*—Arthur D. Dahlberg
*Attorney, Agent, or Firm*—Willis E. Higgins

[57] ABSTRACT

An apparatus (10) for proportioning and mixing liquid components of a solvent has a chamber (12) with a rotatable piston (24) mounted in the chamber. The chamber has a plurality of liquid component inlets (18, 20 and 22). Rotatable piston (24) has a notched portion (30). Relative lengths of time the notched portion (30) is opposite the inlets (18, 20 and 22) determine the proportion of liquid components supplied at each inlet port (18, 20 and 22) in the solvent mixture. Rotation of the piston (24) in the chamber (12) mixes the liquid components introduced through the inlet ports (18, 20 and 22). Stepper motor (32) is controlled by microprocessor (52) driven control system (50) to position the notched portion (30) at the inlet ports (18, 20 and 22) for variable lengths of time.

3 Claims, 6 Drawing Figures

SOLVENT PROPORTIONING AND MIXING APPARATUS AND SYSTEM

BACKGROUND OF THE INVENTION

1. Field of the Invention

This invention relates to a novel apparatus and system for proportioning and mixing a solvent which is made up of a plurality of liquid components. More particularly, it relates to such an apparatus and system in which the liquid components of the solvent are both proportioned and mixed in a single chamber.

2. Description of the Prior Art

It is conventional practice in liquid chromatography to introduce samples to be analyzed to a chromatographic column in a carrier solvent. The carrier solvent typically consists of a mixture of two or more liquid components. During the analysis, the proportions of the liquid components in the solvent may be varied on a linear or non-linear time varying basis. A variety of techniques are known in the art for providing such varying solvent mixtures to the chromatographic columns. For example, U.S. Pat. No. 4,063,077 discloses programmable control circuitry for a valve to access liquid components of a solvent mixture during a defined cycle of operation to proportion the components of the solvent on the basis of the time within the cycle of operation that each component is accessed by the valve. The accessed components are supplied through the valve and a pump to a separate mixer to produce the solvent mixture. U.S. Pat. No. 4,239,623 discloses a system in which each liquid component of the solvent is accessed by separate valves, operated by separate stepper motors. U.S. Pat. No. 4,310,420 discloses a system in which the liquid components of the solvent are separately accessed by solenoid valves. While these prior art systems have proved to be highly suitable for supplying chromatographic solvents, they are both complex and bulky because the liquid component proportioning and mixing are accomplished separately. Because of their size, they also have a delayed response time for the variations in solvent composition. For reasons of compactness and cost, there is a need for a simpler apparatus and system for proportioning and mixing liquid components of a solvent.

SUMMARY OF THE INVENTION

Accordingly, it is an object of this invention to provide an apparatus for proportioning and mixing a solvent including a plurality of liquid components in which both the proportioning and the mixing are carried out in a single unit.

It is another object of the invention to provide such a solvent proportioning and mixing apparatus of reduced size.

It is a further object of the invention to provide such a solvent proportioning and mixing apparatus which will carry out highly accurate, uniform mixing of the liquid components comprising the solvent.

It is still another object of the invention to provide a system incorporating such a solvent proportioning and mixing apparatus with a reduced response time for varying proportions of the liquid components comprising the solvent.

The attainment of these and related objects may be achieved through use of the novel solvent proportioning apparatus and system herein disclosed. The apparatus of this invention proportions and mixes a solvent including and mixing a plurality of liquid components. The apparatus has a chamber with a plurality of inlet ports, each connected to supply one of the plurality of liquid components of the solvent. A member is mounted in the chamber and is movable to different positions for selectively permitting entry of the liquid components to the chamber through the plurality of inlet ports. Different lengths of time the movable member is positioned to allow entry of each liquid component through each of the plurality of inlet ports serves to proportion the plurality of liquid components in the solvent.

Movement of the movable member within the chamber serves to mix the plurality of liquid components. There is an exit from the chamber for the proportioned and mixed solvent. In a preferred embodiment of the invention, the movable member is rotatable in the chamber and is dimensioned to be in close proximity to a wall defining the chamber and thus effecting a seal. The movable member has a notched portion which is positioned to be accessed by each of the plurality of inlet ports as the movable member rotates.

By varying the relative length of time each of the inlet ports is accessed by the notched portion, the amount of each liquid component in the solvent can be varied in a closely controlled manner to constitute from 0 to 100% of the solvent in small and accurate increments.

In practice, the movable member is preferably driven by a stepper motor. The stepper motor is connected to programmable control circuitry which varies the rate the stepper motor moves the movable member and/or the length of time the movable member is stopped to allow entry of a component into the chamber to provide variable lengths of time the movable member is positioned to allow entry of each liquid component through each of the inlet ports. Through use of a suitable program, a user may therefore vary the proportions of the liquid components making up the solvent. Because the solvent is both proportioned and mixed in a single chamber, the apparatus of this invention is compact in size and rapid in response.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
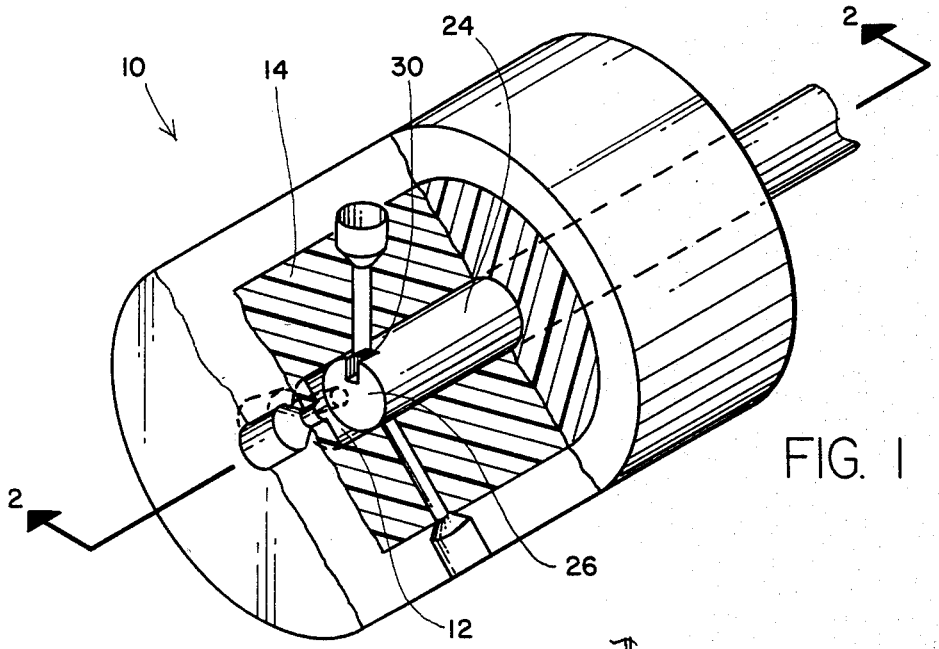
FIG. 1 is a perspective view of apparatus in accordance with the invention, with partial cutaways to show interior detail.
Figure 2:
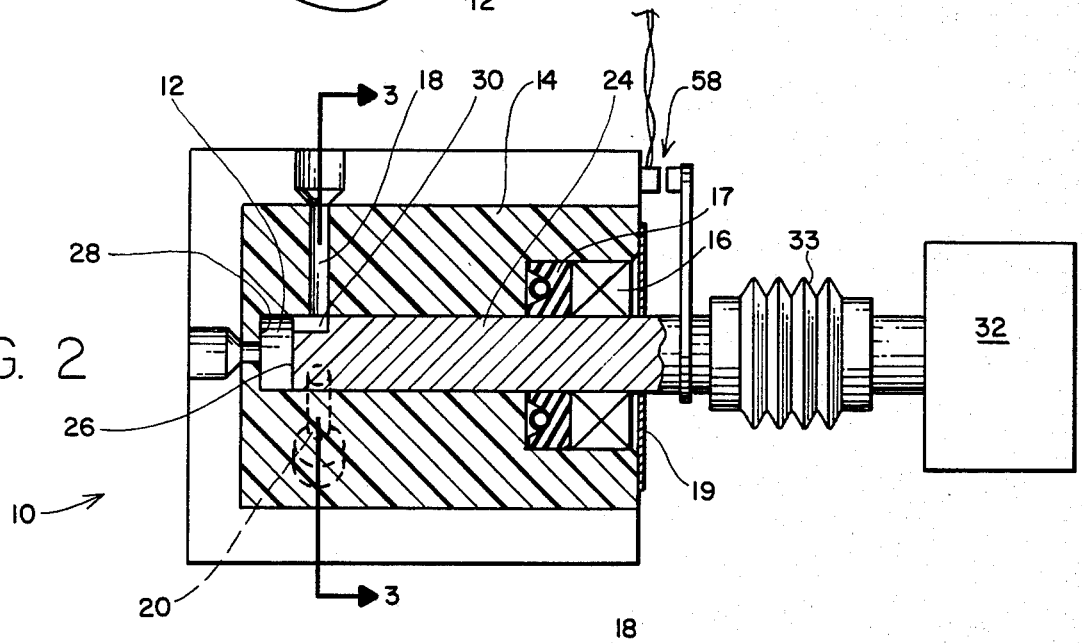
FIG. 2 is a cross-section view taken along the line 2—2 in FIG. 1.
Figure 3:
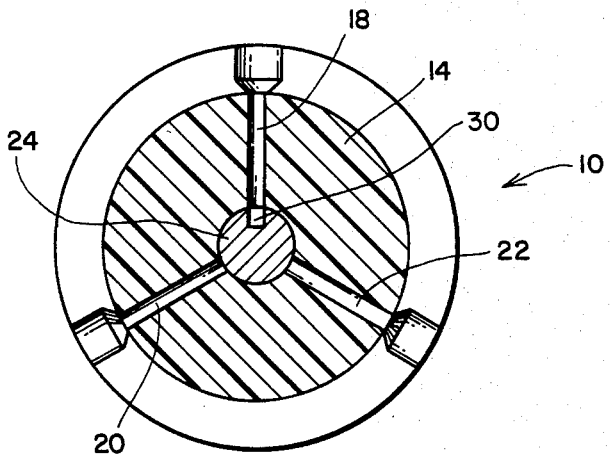
FIG. 3 is a cross section view taken along the line 3—3 in FIG. 2.

Turning now to the drawings, more particularly to FIGS. 1 to 3, there is shown apparatus 10 in accordance with the invention. The apparatus 10 includes a chamber 12, formed by a ceramic tube 14, rotary ball bearing 16, dynamic seal 17 and bearing retainer 19. Liquid component inlet ports 18, 20 and 22 are positioned circumferentially around the tube 14 near the center of its length. A ceramic or other suitable rotatable piston 24 is disposed axially within the chamber 12, through the dynamic seal 17, past the inlets 18, 20 and 22. End 26 of the piston 24 terminates short of end 28 of the chamber 12, thus forming a mixing zone in the chamber 12. Piston 24 has a slotted portion 30 extending from end 26 past the inlet ports 18, 20 and 22. Rotatable piston 24 fits into chamber 12 with a close tolerance, e.g., 500 millionths of an inch. As a result, fluid flow inlet through inlet ports 18, 20 and 22 is blocked by the rotatable piston 24, except when slotted portion 30 is opposite one of the inlet ports 18, 20 and 22. Rotatable piston 24 is connected to stepper motor 32, which is capable of rotating the piston 24 in response to stepping drive pulses up to a relatively high average rate of rotation, such as 300 rpm, through a flexible coupling 33.

In operation, liquid components to be proportioned and mixed are separately supplied to the liquid component inlet ports 18, 20 and 22. Stepper motor 32 rotates the rotatable piston 24 to position the slotted portion 30 opposite the inlet ports 18, 20 and 22. A liquid component is permitted to enter the chamber 12 when the slotted portion 30 is opposite its inlet 18, 20 or 22. The relative lengths of time that the slotted portion 30 is opposite each inlet port 18, 20 and 22 determines the proportion of each liquid component in the resulting solvent mixture. In this operation, the slotted portion 30 is allowed to dwell at each inlet port 18, 20 or 22 for the required time interval. If a liquid component is to be omitted from a solvent composition, its inlet port 18, 20 or 22 can be omitted in the rotation of the piston 24, i.e., the piston 24 may oscillate between two of the inlet ports. The dwell times of the slotted portion 30 at the inlet ports 18, 20 and 22 can be varied with time to give essentially any varying solvent composition profile, as required for liquid chromatography or other application requiring a time varying solvent composition mixture.

Figure 4:
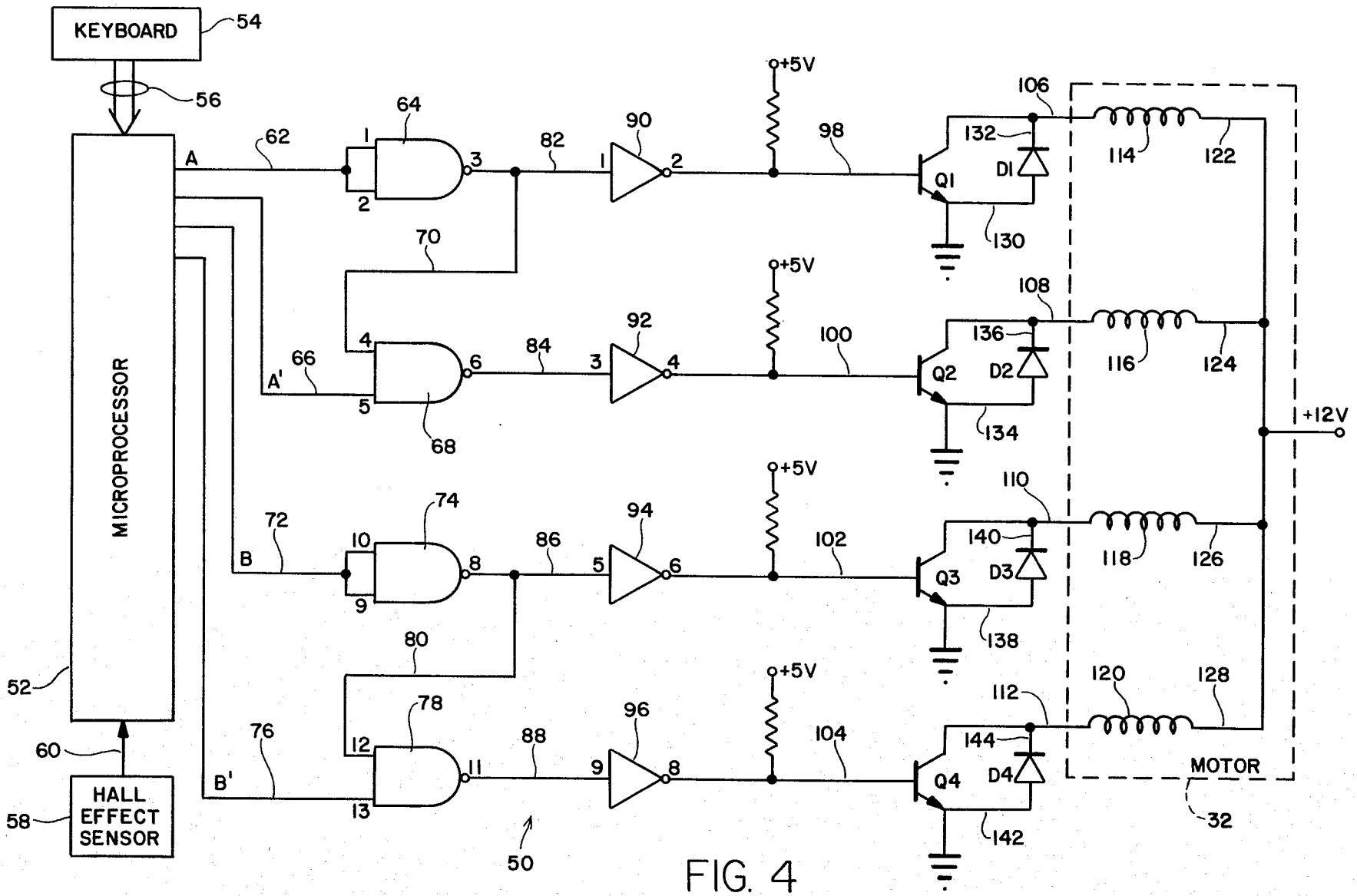
FIG. 4 is a logic and circuit schematic of a portion of a system in accordance with the invention.

FIG. 4 is a block, logic and circuit schematic diagram of a control system 50 for the stepper motor 32. A microprocessor integrated circuit 52, such as an Intel 8080 or 8085 type microprocessor integrated circuit is used to provide control logic for the system 50. A keyboard 54 or other means for providing desired solvent composition input is connected to the microprocessor 52 by lines 56. A position sensor, such as a Hall effect sensor 58 (see also FIG. 2) is connected to provide a position input for the piston 24 on line 60 to the microprocessor 52. An A output from the microprocessor 52 is supplied on line 62 as both inputs of NAND gate 64. An A' input is supplied on line 66 to NAND gate 68. The other input to NAND gate 68 is supplied by the output of NAND gate 64 on line 70. A B output from the microprocessor 52 is supplied on line 72 as both inputs to NAND gate 74. A B' output from the microprocessor 52 is supplied on line 76 as one input to NAND gate 78. The other input to NAND gate 78 is supplied by the output of NAND gate 74 on line 80. The outputs of NAND gates 64, 68, 74 and 78 are respectively supplied on lines 82, 84, 86 and 88 as inputs to inverter buffer/drivers 90, 92, 94 and 96. The inverter buffer/drivers 90, 92, 94 and 96 supply their outputs on lines 98, 100, 102 and 104, respectively, to the bases of transistors Q1, Q2, Q3 and Q4. The collectors of transistors Q1, Q2, Q3 and Q4 are respectively connected by lines 106, 108, 110 and 112 to coils 114, 116, 118 and 120 of the stepper motor 32. Each coil 114, 116, 118 and 120 is also connected to a +12 volt potential source by lines 122, 124, 126 and 128. Diodes D1, D2, D3 and D4 are respectively connected between the emitters and collectors of transistors Q1, Q2, Q3 and Q4 by lines 130 and 132, 134 and 136, 138 and 140, and 142 and 144.

In practice, the NAND gates 64, 68, 74 and 78 may be implemented with a 7400 type quad 2-input NAND integrated circuit. The inverter buffer/drivers 90, 92, 94 and 96 may be implemented with a 7406 type hex inverter buffer/driver integrated circuit. Transistors Q1, Q2, Q3 and Q4 may be implemented with 2N2222 type transistors, and the diodes D1, D2, D3 and D4 may be implemented with 1N4001 type diodes. As shown, the stepper motor 32 is connected for unipolar operation.

Figure 5:
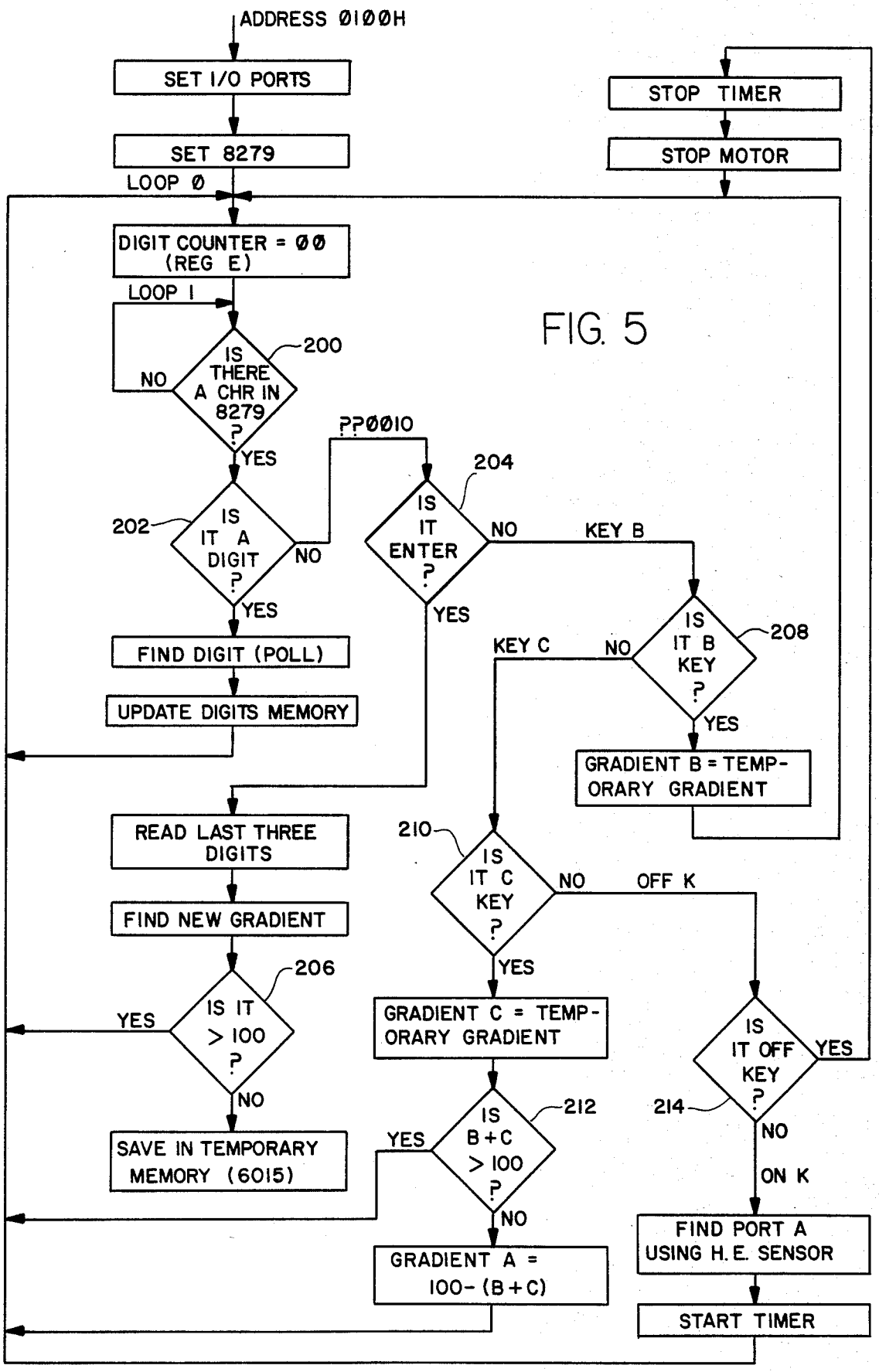
FIG. 5 is a flow diagram for software used in the system of the invention.

FIG. 5 is a software flow diagram for a suitable control program for practising the invention with the microprocessor 52. Decision block 200 determines if there is an entry from keyboard 54. Decision block 202 determines whether the entry is a digit, i.e., whether it is a data entry. Decision block 204 determines whether the input is from the enter function key of the keyboard. Decision block 206 tests the validity of digit entries. Decision block 208 determines whether a digit entry has been selected for a B component, supplied to inlet port 22 (FIGS. 1-3). Decision block 210 determines whether a digit entry is for a C component, supplied to inlet port 20. Decision block 212 tests the validity of B and C component digit entries, and if valid, the proportion of component A is calculated by subtracting the B and C values from 100. Decision block 214 determines whether a function key selecting execution of an entered solvent composition has been selected. If so, the piston 24 is rotated to A inlet port 18, found on the basis of a suitable input from Hall effect sensor 58 to the microprocessor 52.

Figure 6:
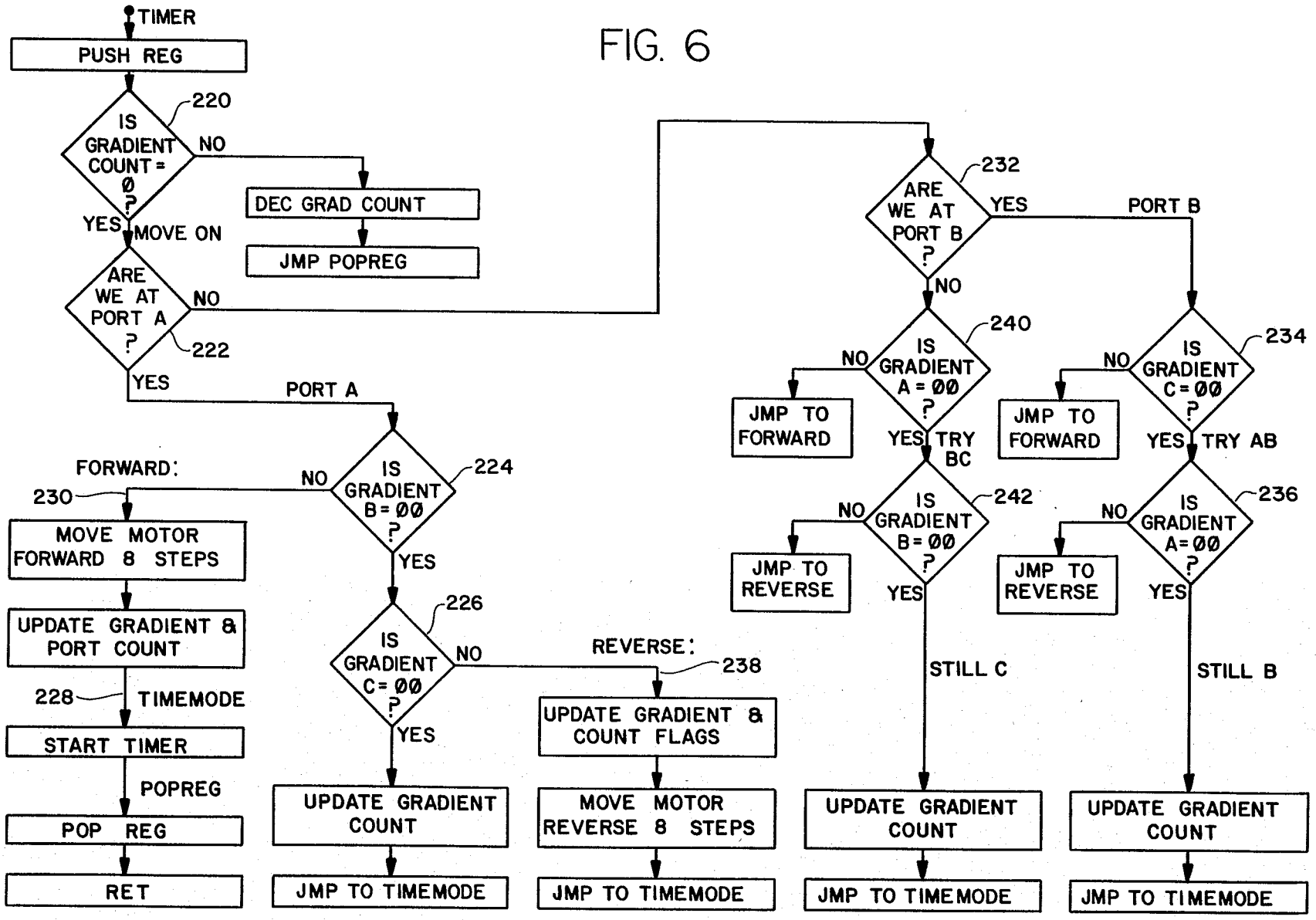
FIG. 6 is a flow diagram of further software used with the invention.

A timer subroutine, shown in FIG. 6, is then started. Decision block 220 determines whether the gradient count equals zero. Decision block 222 determines whether the slotted portion 30 of the piston 24 is at the A port 18. If the notched portion 30 is at the A port 18, decision blocks 224 and 226 test whether the gradients for ports B and C are set at zero. If yes, the gradient count is updated for the A gradient, and the program jumps to timemode at 228 to start timing for component A. When decision block 220 determines that the gradient count for component A equals zero, decision blocks 222 and 224 are executed to determine whether the notched portion 30 should be stepped to B component port 22. If so, subroutine FORW at 230 is executed. Eight steps of the stepper motor 32 represent 120 degrees of revolution and move the notched portion 30 to B inlet port 22.

When decision block 220 determines that the gradient count equals zero and decision block 222 determines that the notched portion 30 is not at A port 18, decision blocks 232 and 234 determine whether the notched portion should be stepped to C component inlet port 22. If the C gradient is not equal to zero, the program again steps to subroutine FORW at 230. When gradient C equals zero, the program goes to decision block 236. If the A gradient is not equal to zero, the program jumps to reverse subroutine at 238 to return the notched portion 30 to A component inlet port 18. If the A gradient is equal to zero, the B gradient is set and timing for the B inlet 20 is carried out. Decision blocks 240 and 242 operate in an analogous fashion.

The attached assembly language program listing for the Intel 8080 or 8085 type microprocessor provides further details on the implementation and operation of the invention.

In summary, the apparatus 10 and system 50 of this invention steps slotted portion 30 of piston 24 in a forward or reverse direction among solvent ports 18, 20 and 22 at a relatively high average motor speed in order both to define a desired solvent mixture and to provide good mixing of the liquid components of the mixture. The system 50 further allows a liquid inlet port 18, 20 or 22 to be avoided if the desired amount of its liquid is zero. The system further provides a sensor 58 for detecting the position of the moving piston 24 as it is rotated.

It should now be readily apparent to those skilled in the art that a solvent proportioning and mixing apparatus and system capable of achieving the stated objects of the invention has been provided. A solvent consisting of mixed liquid components may be both mixed and proportioned in a single unit of reduced size which will mix the liquid components uniformly. As a result, a reduced response time for varying proportions of the liquid components in the solvent may be achieved.

It should further be apparent to those skilled in the art that various changes in form and details of the invention as shown and described may be made. For example, a servomotor could be substituted for the stepper motor 32. It is intended that such changes be included within the spirit and scope of the claims appended hereto.

```
ISIS-II 8080/8085 MACRO ASSEMBLER, V4.1
 LOC  OBJ          LINE        SOURCE STATEMENT

                     1 ;                PROGRAM MIXER
                     2 ;
                     3 ;
                     4 POLL             MACRO   G1
                     5                  LOCAL   G2
 -                   6                  CPI     G1
 -                   7                  JNZ     G2
 -                   8                  LDA     4031H          ;UPDATE THE GRADIENT
 -                   9                  STA     4032H          ;GRADIENT == LAST THREE DIGIT ENTERED
 -                  10                  LDA     4030H
 -                  11                  STA     4031H
 -                  12                  MOV     A,E
 -                  13                  STA     4030H
 -                  14                  JMP     LOOP0
 -                  15 G2:              INR     E
                    16                  ENDM
                    17                  CSEG
 0000               18                  ORG     0000H
 0000 C30001        19                  JMP     0100H
 003C               20                  ORG     003CH
 003C C31803    C   21                  JMP     TIMER          ;SETS ADDRESS OF INTERRUPT
                    22                                         ;
                    23                                         ;
                    24          ;PROGRAM STARTS HERE
                    25                                         ;
                    26                                         ;
 0100               27                  ORG     0100H
 0100 31EF40        28                  LXI     SP,40EFH
 0103 3E1B          29                  MVI     A,1BH
 0105 30            30                  SIM
 0106 3E0C          31                  MVI     A,0CH          ;SET IO PORTS
 0108 D340          32                  OUT     40H
 010A 3E08          33                  MVI     A,08           ;SETS 8279
 010C D361          34                  OUT     61H
 010E 3E3F          35                  MVI     A,3FH          ;
 0110 D361          36                  OUT     61H
 0112 3EDF          37                  MVI     A,0DFH
 0114 D361          38                  OUT     61H
 0116 3E40          39                  MVI     A,40H          ;
 0118 D361          40                  OUT     061H           ;SETS 8279 TO READ KEYBOARD
 011A 1E00          41 LOOP0:           MVI     E,00H
 011C FB            42 LOOP1:           EI
 011D DB61          43                  IN      061H           ;SETS STATUS REGISTER
 011F E60F          44                  ANI     0FH
```

```
0121 CA1C01   C    45                JZ      LOOP1          ;WAIT FOR CHARACTER
0124 DB60          46                IN      60H
                   47                POLL    0CCH           ;IS IT A 0
0126 FECC          48+               CPI     0CCH
0128 C23E01   C    49+               JNZ     ??0001
012B 3A3140        50+               LDA     4031H          ;UPDATE THE GRADIENT
012E 323240        51+               STA     4032H          ;GRADIENT == LAST THREE DIGIT ENTERED
0131 3A3040        52+               LDA     4030H
0134 323140        53+               STA     4031H
0137 7B            54+               MOV     A,E
0138 323040        55+               STA     4030H
013B C31A01   C    56+               JMP     LOOP0
013E 1C            57+??0001:        INR     E
                   58                POLL    0DBH           ;IS IT A 1
013F FEDB          59+               CPI     0DBH
0141 C25701   C    60+               JNZ     ??0002
0144 3A3140        61+               LDA     4031H          ;UPDATE THE GRADIENT
0147 323240        62+               STA     4032H          ;GRADIENT == LAST THREE DIGIT ENTERED
014A 3A3040        63+               LDA     4030H
014D 323140        64+               STA     4031H
0150 7B            65+               MOV     A,E
0151 323040        66+               STA     4030H
0154 C31A01   C    67+               JMP     LOOP0
0157 1C            68+??0002:        INR     E
                   69                POLL    0D3H           ;IS IT A 2
0158 FED3          70+               CPI     0D3H
015A C27001   C    71+               JNZ     ??0003
015D 3A3140        72+               LDA     4031H          ;UPDATE THE GRADIENT
0160 323240        73+               STA     4032H          ;GRADIENT == LAST THREE DIGIT ENTERED
0163 3A3040        74+               LDA     4030H
0166 323140        75+               STA     4031H
0169 7B            76+               MOV     A,E
016A 323040        77+               STA     4030H
016D C31A01   C    78+               JMP     LOOP0
0170 1C            79+??0003:        INR     E
                   80                POLL    0CBH           ;IS IT A 3
0171 FECB          81+               CPI     0CBH
0173 C28901   C    82+               JNZ     ??0004
0176 3A3140        83+               LDA     4031H          ;UPDATE THE GRADIENT
0179 323240        84+               STA     4032H          ;GRADIENT == LAST THREE DIGIT ENTERED
017C 3A3040        85+               LDA     4030H
017F 323140        86+               STA     4031H
0182 7B            87+               MOV     A,E
0183 323040        88+               STA     4030H
0186 C31A01   C    89+               JMP     LOOP0
0189 1C            90+??0004:        INR     E
                   91                POLL    0DAH           ;IS IT A 4
```

```
018A FEDA          92+          CPI     0DAH
018C C2A201   C    93+          JNZ     ??0005
018F 3A3140        94+          LDA     4031H          ;UPDATE THE GRADIENT
0192 323240        95+          STA     4032H          ;GRADIENT == LAST THREE DIGIT ENTERED
0195 3A3040        96+          LDA     4030H
0198 323140        97+          STA     4031H
019B 7B            98+          MOV     A,E
019C 323040        99+          STA     4030H
019F C31A01   C   100+          JMP     LOOP0
01A2 1C           101+??0005:   INR     E
                  102           POLL    0D2H           ;IS IT A 5
01A3 FED2         103+          CPI     0D2H
01A5 C2BB01   C   104+          JNZ     ??0006
01A8 3A3140       105+          LDA     4031H          ;UPDATE THE GRADIENT
01AB 323240       106+          STA     4032H          ;GRADIENT == LAST THREE DIGIT ENTERED
01AE 3A3040       107+          LDA     4030H
01B1 323140       108+          STA     4031H
01B4 7B           109+          MOV     A,E
01B5 323040       110+          STA     4030H
01B8 C31A01   C   111+          JMP     LOOP0
01BB 1C           112+??0006:   INR     E
                  113           POLL    0CAH           ;IS IT A 6
01BC FECA         114+          CPI     0CAH
01BE C2D401   C   115+          JNZ     ??0007
01C1 3A3140       116+          LDA     4031H          ;UPDATE THE GRADIENT
01C4 323240       117+          STA     4032H          ;GRADIENT == LAST THREE DIGIT ENTERED
01C7 3A3040       118+          LDA     4030H
01CA 323140       119+          STA     4031H
01CD 7B           120+          MOV     A,E
01CE 323040       121+          STA     4030H
01D1 C31A01   C   122+          JMP     LOOP0
01D4 1C           123+??0007:   INR     E
                  124           POLL    0D9H           ;IS IT A 7
01D5 FED9         125+          CPI     0D9H
01D7 C2ED01   C   126+          JNZ     ??0008
01DA 3A3140       127+          LDA     4031H          ;UPDATE THE GRADIENT
01DD 323240       128+          STA     4032H          ;GRADIENT == LAST THREE DIGIT ENTERED
01E0 3A3040       129+          LDA     4030H
01E3 323140       130+          STA     4031H
01E6 7B           131+          MOV     A,E
01E7 323040       132+          STA     4030H
01EA C31A01   C   133+          JMP     LOOP0
01ED 1C           134+??0008:   INR     E
                  135           POLL    0D1H           ;IS IT AN 8
01EE FED1         136+          CPI     0D1H
01F0 C20602   C   137+          JNZ     ??0009
01F3 3A3140       138+          LDA     4031H          ;UPDATE THE GRADIENT
```

```
01F6 323240        139+                STA     4032H          ;GRADIENT == LAST THREE DIGIT ENTERED
01F9 3A3040        140+                LDA     4030H
01FC 323140        141+                STA     4031H
01FF 7B            142+                MOV     A,E
0200 323040        143+                STA     4030H
0203 C31A01    C   144+                JMP     LOOP0
0206 1C            145+??0009:         INR     E
                   146                 POLL    0C9H           ;IS IT A 9
0207 FEC9          147+                CPI     0C9H
0209 C21F02    C   148+                JNZ     ??0010
020C 3A3140        149+                LDA     4031H          ;UPDATE THE GRADIENT
020F 323240        150+                STA     4032H          ;GRADIENT == LAST THREE DIGIT ENTERED
0212 3A3040        151+                LDA     4030H
0215 323140        152+                STA     4031H
0218 7B            153+                MOV     A,E
0219 323040        154+                STA     4030H
021C C31A01    C   155+                JMP     LOOP0
021F 1C            156+??0010:         INR     E
0220 FED4          157                 CPI     0D4H           ;CHECK FOR  ENTER
0222 C25102    C   158                 JNZ     KEYB
0225 2600          159                 MVI     H,00
0227 3A3040        160                 LDA     4030H          ;GET LAST DIGIT READ
022A 6F            161                 MOV     L,A            ;SPEED=LAST DIGIT READ
022B 3A3140        162                 LDA     4031H
022E 57            163                 MOV     D,A
022F 0E0A          164                 MVI     C,0AH          ;LOAD 10 IN REG C
0231 CDE102    C   165                 CALL    MULT
0234 09            166                 DAD     B              ;SPEED=10*LDR+SPEED
0235 3A3240        167                 LDA     4032H
0238 57            168                 MOV     D,A
0239 0E64          169                 MVI     C,100          ;C=100
023B CDE102    C   170                 CALL    MULT
023E 09            171                 DAD     B              ;SPEDD=100*LDR+SPEED
023F 7C            172                 MOV     A,H            ;GRADIENT>>THAN 100%
0240 FE00          173                 CPI     00
0242 C21A01    C   174                 JNZ     LOOP0
0245 7D            175                 MOV     A,L            ;GRADIENT>100%
0246 FE65          176                 CPI     65H
0248 D21A01    C   177                 JNC     LOOP0
024B 321540        178                 STA     4015H
024E C31A01    C   179                 JMP     LOOP0
0251 FED0          180 KEYB:           CPI     0D0H           ;IS IT GRADIENT B
0253 C25F02    C   181                 JNZ     KEYC
0256 3A1540        182                 LDA     4015H          ;A=GRADIENT B
0259 322040        183                 STA     4020H
025C C31A01    C   184                 JMP     LOOP0
025F FEC8          185 KEYC:           CPI     0C8H           ;IS IT GRADIENT A
```

```
0261 C26102   C   186                JNZ   OFFK
0264 3A1540       187                LDA   4015H        ;A =GRADIENT C
0267 322140       188                STA   4021H
026A C3F702   C   189                JMP   CHECK
026D FEC2         190 OFFK:          CPI   0C2H         ;IS IT STOP
026F C27C02   C   191                JNZ   ONK
0272 3E4E         192                MVI   A,04EH
0274 D340         193                OUT   40H          ;STOP TIMER
0276 AF           194                XRA   A
0277 D343         195                OUT   43H
0279 C31A01   C   196                JMP   LOOP0
027C FEC1         197 ONK:           CPI   0C1H         ;IS IT START
027E C21A01   C   198                JNZ   LOOP0
0281 DB41         199 FINDA:         IN    41H
0283 E601         200                ANI   01
0285 FE00         201                CPI   00           ;CHECK FOR HALL EFFECT SIGNAL
0287 CA9B02   C   202                JZ    MOVE
028A AF           203                XRA   A
028B 320440       204                STA   4004H
028E D344         205                OUT   44H          ;LOAD 1800X2 MILLISECONDS INTO  TIMER)
0290 3E08         206                MVI   A,0D8H       ;LOAD MODE INTO TIMER
0292 D345         207                OUT   45H
0294 3ECC         208                MVI   A,0CCH
0296 D340         209                OUT   40H          ;START TIMER
0298 C31A01   C   210                JMP   LOOP0
029B 0605         211 MOVE:          MVI   B,05H
029D 0E57         212 LUS:           MVI   C,057H
029F 0D           213 INUS:          DCR   C            ;5-3 SOFTWARE TIMER
02A0 C29F02   C   214                JNZ   INUS
02A3 05           215                DCR   B
02A4 C29D02   C   216                JNZ   LUS
02A7 3A0840       217                LDA   4008H        ;GET  PRESENT SEQUENCE
02AA FE05         218                CPI   05
02AC C2B902   C   219                JNZ   NINE
02AF 3E09         220                MVI   A,09         ;ITS 05
02B1 320840       221                STA   4008H
02B4 D343         222                OUT   43H
02B6 C38102   C   223                JMP   FINDA
02B9 FE09         224 NINE:          CPI   09
02BB C2C802   C   225                JNZ   TEN
02BE 3E0A         226                MVI   A,0AH
02C0 320840       227                STA   4008H
02C3 D343         228                OUT   43H
02C5 C38102   C   229                JMP   FINDA
02C8 FE0A         230 TEN:           CPI   0AH
02CA C2D702   C   231                JNZ   SIX
02CD 3E06         232                MVI   A,06H
```

```
02CF 320840          233                    STA     4008H
02D2 D343            234                    OUT     43H
02D4 C38102    C     235                    JMP     FINDA
02D7 3E05            236 SIX:               MVI     A,05
02D9 320840          237                    STA     4008H
02DC D343            238                    OUT     43H
02DE C38102    C     239                    JMP     FINDA
                     240 ;$MULTIPLICATION 8 BY 8
                     241 ;THIS ROUTINE MULTIPLIES C,D AND STORES IT IN BC
                     242 ;IT IS EXPLAINED IN INTEL'S 8085 ASB LANG MANUAL PAG 6-9
02E1 0600            243 MULT:              MVI     B,0
02E3 1E09            244                    MVI     E,9
02E5 79              245 MULT0:             MOV     A,C
02E6 1F              246                    RAR
02E7 4F              247                    MOV     C,A
02E8 1D              248                    DCR     E
02E9 CAF602    C     249                    JZ      MULT4
02EC 78              250                    MOV     A,B
02ED D2F102    C     251                    JNC     MULT1
02F0 82              252                    ADD     D
02F1 1F              253 MULT1:             RAR
02F2 47              254                    MOV     B,A
02F3 C3E502    C     255                    JMP     MULT0
02F6 C9              256 MULT4:             RET
02F7 3A2040          257 CHECK:             LDA     4020H
02FA 47              258                    MOV     B,A
02FB 3A2140          259                    LDA     4021H
02FE 80              260                    ADD     B
02FF FE65            261                    CPI     65H
0301 D21A01    C     262                    JNC     LOOP0           ;B+C>100 ERROR. GRADIENT NOT CHANGED
0304 4F              263                    MOV     C,A
0305 3E64            264                    MVI     A,64H
0307 91              265                    SUB     C
0308 320140          266                    STA     4001H
030B 78              267                    MOV     A,B
030C 320240          268                    STA     4002H
030F 3A2140          269                    LDA     4021H
0312 320340          270                    STA     4003H
0315 C31A01    C     271                    JMP     LOOP0
0318 F5              272 TIMER:             PUSH    PSW
0319 C5              273                    PUSH    B
031A D5              274                    PUSH    D
031B E5              275                    PUSH    H
031C 3A1040          276                    LDA     4010H           ;GET REMAINING COUNT
031F 3D              277                    DCR     A
0320 FE00            278                    CPI     00H             ;ARE WE READY TO MOVE ON TO NEXT PORT?
0322 CA2B03    C     279                    JZ      MOVEON
```

```
0325 321040        280                STA     4010H          ;UPDATE GRADIENT COUNT
0328 C3B204    C   281                JMP     POPREG
032B 3E4C          282 MOVEON:        MVI     A,4CH
032D D340          283                OUT     40H            ;STOP TIMER
032F 3A0440        284                LDA     4004H
0332 FE00          285                CPI     00H
0334 CA9803    C   286                JZ      PORTA          ;ARE WE AT PORT A?
0337 FE0F          287                CPI     0FH            ;NOP
0339 CA6A03    C   288                JZ      PORTB          ;ARE WE AT PORT B
033C 3A0140        289                LDA     4001H          ;WE'RE AT PORT C.
033F FE00          290                CPI     00H            ;DO WE NEED TO GO TO PORT A
0341 CA4E03    C   291                JZ      TRYBC
0344 321040        292                STA     4010H
0347 AF            293                XRA     A
0348 320440        294                STA     4004H          ;UPDATE POSITION FLAG
034B C3C703    C   295                JMP     FORW
034E 3A0240        296 TRYBC:         LDA     4002H
0351 FE00          297                CPI     00
0353 CA6103    C   298                JZ      STILLC
0356 321040        299                STA     4010H          ;UPDATE GRADIENT COUNT
0359 3E0F          300                MVI     A,0FH
035B 320440        301                STA     4004H          ;UPDATE POSITION FLAG
035E C3370 4    C  302                JMP     REVERSE
0361 3A0340        303 STILLC:        LDA     4003H
0364 321040        304                STA     4010H          ;UPDATE GRADIENT COUNT
0367 C3A704    C   305                JMP     TIMEMODE
036A 3A0340        306 PORTB:         LDA     4003H
036D FE00          307                CPI     00H
036F CA7D03    C   308                JZ      TRYAB
0372 321040        309                STA     4010H
0375 3EFF          310                MVI     A,0FFH
0377 320440        311                STA     4004H          ;UPDATE POSITION FLAG
037A C3C703    C   312                JMP     FORW
037D 3A0140        313 TRYAB:         LDA     4001H
0380 FE00          314                CPI     00
0382 CA8F03    C   315                JZ      STILLB
0385 321040        316                STA     4010H          ;UPDATE GRADIENT COUNT
0388 AF            317                XRA     A
0389 320440        318                STA     4004H          ;UPDATE POSITION FLAG
038C C3370 4    C  319                JMP     REVERSE
038F 3A0240        320 STILLB:        LDA     4002H
0392 321040        321                STA     4010H          ;UPDATE GRADIENT COUNT
0395 C3A704    C   322                JMP     TIMEMODE
0398 3A0240        323 PORTA:         LDA     4002H
039B FE00          324                CPI     00
039D CAAB03    C   325                JZ      TRYAC
03A0 321040        326                STA     4010H          ;UPDATE GRADIENT COUNT
```

```
03A3 3E0F          327                MVI     A,0FH
03A5 320440        328                STA     4004H          UPDATE POSITION FLAG
03A8 C3C703    C   329                JMP     FORW
03AB 3A0340        330 TPYAC:         LDA     4003H
03AE FE00          331                CPI     00H
03B0 CABE03    C   332                JZ      STILLA
03B3 321040        333                STA     4010H          ;UPDATE GRADIENT COUNT
03B6 3EFF          334                MVI     A,0FFH
03B8 320440        335                STA     4004H          ;UPDATE POSITION FLAG
03BB C33704    C   336                JMP     REVERSE
03BE 3A0140        337 STILLA:        LDA     4001H
03C1 321040        338                STA     4010H
03C4 C3A704    C   339                JMP     TIMEMODE
03C7 0600          340 FORW:          MVI     B,00
03C9 78            341 FORWARD:       MOV     A,B
03CA FE08          342                CPI     08H
03CC CAA704    C   343                JZ      TIMEMODE
03CF FE00          344                CPI     00
03D1 CAE803    C   345                JZ      FMILLI
03D4 FE07          346                CPI     07
03D6 CAE803    C   347                JZ      FMILLI
03D9 FE01          348                CPI     01
03DB CAED03    C   349                JZ      TMILLI
03DE FE06          350                CPI     06
03E0 CAED03    C   351                JZ      TMILLI
03E3 1E01          352                MVI     E,01
03E5 C3EF03    C   353                JMP     PLUS
03E8 1E05          354 FMILLI:        MVI     E,05H
03EA C3EF03    C   355                JMP     PLUS
03ED 1E03          356 TMILLI:        MVI     E,03
03EF 0E57          357 PLUS:          MVI     C,57H
03F1 0D            358 MINUS:         DCR     C
03F2 C2F103    C   359                JNZ     MINUS
03F5 1D            360                DCR     E
03F6 C2EF03    C   361                JNZ     PLUS
03F9 3A0840        362                LDA     4008H
03FC FE05          363                CPI     05
03FE C20C04    C   364                JNZ     FNINE
0401 3E09          365                MVI     A,09           ;ITS 05
0403 320840        366                STA     4008H
0406 D343          367                OUT     43H
0408 04            368                INR     B
0409 C3C903    C   369                JMP     FORWARD
040C FE09          370 FNINE:         CPI     09
040E C21C04    C   371                JNZ     FTEN
0411 3E0A          372                MVI     A,0AH
0413 320840        373                STA     4008H
```

```
0416 D343          374                OUT     43H
0418 04            375                INR     B
0419 C3C903    C   376                JMP     FORWARD
041C FE0A          377 FTEN:          CPI     0AH
041E C22C04    C   378                JNZ     FSIX
0421 3E06          379                MVI     A,06H
0423 320840        380                STA     4008H
0426 D343          381                OUT     43H
0428 04            382                INR     B
0429 C3C903    C   383                JMP     FORWARD
042C 3E05          384 FSIX:          MVI     A,05
042E 320840        385                STA     4008H
0431 D343          386                OUT     43H
0433 04            387                INR     B
0434 C3C903    C   388                JMP     FORWARD
0437 0600          389 REVERSE:       MVI     B,00
0439 78            390 REV:           MOV     A,B
043A FE08          391                CPI     08H
043C CAA704    C   392                JZ      TIMEMODE
043F FE00          393                CPI     00H
0441 CA5804    C   394                JZ      FRS
0444 FE07          395                CPI     07
0446 CA5804    C   396                JZ      FRS
0449 FE01          397                CPI     01
044B CA5D04    C   398                JZ      TRS
044E FE06          399                CPI     06
0450 CA5D04    C   400                JZ      TRS
0453 1E01          401                MVI     E,01
0455 C35F04    C   402                JMP     RPLUS
0458 1E05          403 FRS:           MVI     E,05
045A C35F04    C   404                JMP     RPLUS
045D 1E01          405 TRS:           MVI     E,01
045F 0E57          406 RPLUS:         MVI     C,57H
0461 0D            407 RMINUS:        DCR     C
0462 C26104    C   408                JNZ     RMINUS
0465 1D            409                DCR     E
0466 C25F04    C   410                JNZ     RPLUS
0469 3A0840        411                LDA     4008H
046C FE05          412                CPI     05
046E C27C04    C   413                JNZ     RNINE
0471 3E06          414                MVI     A,06          ;ITS 05
0473 320840        415                STA     4008H
0476 D343          416                OUT     43H
0478 04            417                INR     B
0479 C33904    C   418                JMP     REV
047C FE09          419 RNINE:         CPI     09
047E C28C04    C   420                JNZ     RTEN
```

```
0481 3E05          421                MVI     A,05H
0483 320840        422                STA     4008H
0486 D343          423                OUT     43H
0488 04            424                INR     B
0489 C33904    C   425                JMP     REV
048C FE0A          426 RTEN:          CPI     0AH
048E C29C04    C   427                JNZ     RSIX
0491 3E09          428                MVI     A,09H
0493 320840        429                STA     4008H
0496 D343          430                OUT     43H
0498 04            431                INR     B
0499 C33904    C   432                JMP     REV
049C 3E0A          433 RSIX:          MVI     A,0AH
049E 320840        434                STA     4008H
04A1 D343          435                OUT     43H
04A3 04            436                INR     B
04A4 C33904    C   437                JMP     REV
04A7 AF            438 TIMEMODE:      XRA     A
04A8 D344          439                OUT     44H
04AA 3ED8          440                MVI     A,0D8H
04AC D345          441                OUT     45H
04AE 3ECC          442                MVI     A,0CCH
04B0 D340          443                OUT     40H
04B2 F1            444 POPREG:        POP     PSW
04B3 C1            445                POP     B
04B4 D1            446                POP     D
04B5 E1            447                POP     H
04B6 C9            448                RET
                   449 END
PUBLIC SYMBOLS
EXTERNAL SYMBOLS
USER SYMBOLS
CHECK  C 02F7   FINDA  C 0281   FMILLI C 03E8   FNINE  C 040C   FORM   C 02C7   FORMAP C 02C9   FPS    C 045B
FSIX   C 042C   FTEN   C 041C   INUS   C 029F   KEYB   C 0251   KEYC   C 025F   LOOP0  C 011A   LOOP1  C 011L
LUS    C 029D   MINUS  C 03F1   MOVE   C 029B   MOVEON C 032B   MULT   C 02E1   MULT0  C 02E5   MULT1  C 02F1
MULT4  C 02F6   NINE   C 02B9   OFFK   C 026D   ONK    C 027C   PLUS   C 03EF   POLL   + 0000   POPREG C 04B2
PORTA  C 0398   PORTB  C 036A   REV    C 0439   REVERS C 0437   PMINUS C 0451   PNINE  C 047C   PPLUS  C 045F
RSIX   C 049C   RTEN   C 048C   SIX    C 02D7   STILLA C 03BE   STILLB C 038F   STILLC C 0361   TEN    C 02C9
TIMEMO C 04A7   TIMER  C 0318   TMILLI C 03ED   TRS    C 045D   TRYAB  C 037D   TRYAC  C 03AB   TRYBC  C 034E
ASSEMBLY COMPLETE,    NO ERRORS
```

What is claimed is:

1. A system for proportioning and mixing a solvent including a plurality of liquid components, which comprises a chamber having a plurality of inlet ports each connected to supply one of the plurality of liquid components, a member mounted in said chamber and being movable to different positions for selectively permitting entry of the liquid components to said chamber through said plurality of inlet ports, different lengths of time the movable member is positioned to allow entry of each liquid component through each of said plurality of inlet ports serving to proportion the plurality of liquid components, and movement of said movable member within said chamber serving to mix the plurality of liquid components, an exit from said chamber for the proportioned and mixed solvent, a motor with positional feedback connected to move said movable member, means connected to sense a position of said movable member, to determine a next position of said movable member, and to provide variable lengths of time the movable member is positioned to allow entry of each liquid comonent through each of said plurality of inlet ports.

2. The apparatus of claim 1 in which said movable member is rotatably movable in said chamber, said movable member having a notched portion, said movable member serving to block entry of a liquid component through each of said inlet ports except when said notched portion is positioned at one of said inlet ports.

3. The apparatus of claim 2 in which said movable member is dimensioned to be in close proximity to a wall defining said chamber.

* * * * *